United States Patent [19]

Brehm et al.

[11] 4,223,604

[45] Sep. 23, 1980

[54] QUICK-ACTING CLAMPING DEVICE

[75] Inventors: Bernd Brehm; Fritz Kluzik, both of Frankenthal, Fed. Rep. of Germany

[73] Assignee: Albert-Frankenthal AG, Frankenthal, Fed. Rep. of Germany

[21] Appl. No.: 946,910

[22] Filed: Sep. 28, 1978

[30] Foreign Application Priority Data

Oct. 1, 1977 [DE] Fed. Rep. of Germany ..... 2744371

[51] Int. Cl.[2] ..... B41F 1/28

[52] U.S. Cl. ..... 101/415.1; 101/378; 101/383

[58] Field of Search ..... 101/415.1, 383, 378, 101/390

[56] References Cited

U.S. PATENT DOCUMENTS

| | | | |
|---|---|---|---|
| 2,309,161 | 1/1943 | Breman | 101/415.1 |
| 2,764,089 | 9/1956 | Bachman | 101/415.1 |

*Primary Examiner*—Edgar S. Burr
*Assistant Examiner*—A. J. Heinz
*Attorney, Agent, or Firm*—Allison C. Collard; Thomas M. Galgano

[57] ABSTRACT

A device is provided for the rapid clamping of flexible printing plates on the printing cylinder of rotary printing presses which includes a support bar mounted within and adjacent to the front side of a cylinder groove to which the forward end of plate is clamped by means of clamping springs and a clamping arm disposed opposite of the support bar, which is pivotably mounted within and adjacent to the rear side of the groove and has a plate attachment arm to which the rear end of the plate is clamped. The clamping arm is actuated by means of pressure springs in the clamping direction and in the counter direction by adjustment means so that the plate ends may be clamped independently from one another as well as independently of the plate thickness so as to prevent damage to the plates during the clamping operation and an easy servicing. For this purpose, the support bar and the clamping arm are provided with at least one clamping spring which is engaged by a movable slide which, in turn, is actuated by an actuating pawl extending into the cylinder groove, so that they can be actuated or inactivated relative to the support bar or the clamping arm to which they are attached independently from each other and independently from a pivot movement of the clamping arm.

16 Claims, 5 Drawing Figures

QUICK-ACTING CLAMPING DEVICE

The invention relates to a device for the quick-acting clamping of flexible printing plates on the printing cylinder of rotary printing presses, in particular offset rotary printing presses. More particularly, it relates to such a device having at least one support bar positioned at the front side, with respect to the direction of rotation, of a groove running parallel to the axis, and being firmly bolted to the floor of the groove, which support bar has a plate attachment arm to which the front end, with respect to the direction of rotation, of a printing plate can be clamped, and having at least one clamping arm lying opposite the support bar and being swingably mounted, said clamping arm exhibiting a bearer arm having joined almost vertically to it a plate attachment arm to which the rear end, with respect to the direction of rotation, of a printing plate can be clamped, whereby the clamping arm can be acted upon in the clamping direction by means of pressure springs extending approximately in direction of the plate attachment arm, and by means of an adjusting device can be actuated against the force of the pressure springs.

In known arrangements of this nature several clamping springs being arranged next to one another are used for gripping the ends of the plate prior to the actual clamping process; the clamping springs are fixed in each case to the support bar, bridge the free groove opening and reach across into the region of the clamping arm. There should thus be a constant squeezing between support bar and clamping springs. When the clamping arm is retracted, i.e., is actuated against the force of the pressure springs, a free space can result in the region of the clamping arm between the end of the clamping spring in question and the plate attachment arm of the clamping arm. The plate end to be fixed to the support bar should be brought into position by simply pressing this end with the necessary force in between the plate attachment arm and the corresponding clamping spring. This is obviously not only clumsy and difficult, but also very dangerous with respect to possibly damaging the edge of the plate, which can have unfavorable consequences as regards the registration stability. Especially in the case of printing plates which are to be used several times, utmost care must be taken here, which complicates the clamping process and results in long periods of machine disuse. It is also to be feared that with arrangements of known nature only printing plates having correspondingly rigid edges, i.e., printing plates of up to a certain minimum strength only, can be clamped.

On the other hand, the plate end to be fixed in the region of the clamping arm cannot be gripped at all in this case before the actual clamping process is begun, i.e., before actuating the clamping arm in the operating direction prescribed by the pressure springs. Only when the clamping arm is moved forward and the clamping spring becomes compressed as the clamping process proceeds is there any gripping effect. This, however, makes the clamping process extremely complicated and awkward, since the plate end in question must in practice be held in position by hand until the clamping spring starts to grip as the clamping arm is actuated. This requires not only the utmost of effort and concentration on the part of the operator, but in known setups cannot even be accomplished by one operator alone, since the adjusting device for actuating the clamping arm consists in a worm gear which is housed in a ring positioned at the edge of the cylinder and which accordingly can in practice only be operated from the machine side. This can furthermore necessitate a highly undesirable recess in the region of the bearer ring. Thus, the coupling of the gripping and clamping processes represents an extremely serious source of error. Quite apart from this, the clamping springs bridging the free groove opening prove to be extremely bulky and are accordingly not easily accessible. At the same time, when using springs of this sort, a relatively large pitch and thus undesirably long elongation must be reckoned with.

There are already arrangements known having individual springs which, with the help of a pin fixed at the edge of the groove and passing through the neighboring clamping arm, can be disconnected from the respective clamping arm when this moves back. However, arrangements of this sort cannot be used for devices according to the preamble having a rigid support bar. Quite apart from this, the clamping springs here too only become effective when the clamping arm is actuated. In addition, a highly undesirable weakening of the edge of the groove, which is under high load anyway, is to be feared in this case.

Starting out from this, it is the object of the present invention to provide a quick-acting clamping device of the sort mentioned at the beginning, avoiding the disadvantages of the known arrangements and being not only simply constructed, where relatively small spring elongations suffice, but also guaranteeing quick and obvious operation, making exact plate clamping possible also for one-man operation, and simultaneously excluding, to a large extent, the danger of damaging the plates, even when thin plates are being used.

The problem is solved according to the invention in a surprisingly simple way, namely in that the support bar and the clamping bar are each provided, for gripping the corresponding plate end, with at least one clamping spring which, independently of each other and of any swinging movement of the clamping arm, can be brought in or out of contact with the corresponding opposing surface of the support bar or clamping bar respectively.

This measure guarantees that every plate end can be gripped exactly in position before starting the actual clamping action, which substantially facilitates the clamping action, makes short start-up times possible and nevertheless guarantees high accuracy. Furthermore, in arrangements of this sort very short spring elongation suffices, which not insubstantially simplifies the adjusting device for actuating the clamping arm. This enables space-saving and compact construction. As a result of the means according to the invention for connecting or disconnecting the clamping springs, the plates can be treated with the utmost care quite independently of their respective thickness, so that even relatively thin printing plates can be used without any trouble, and relatively thick printing plates can be clamped with hardly any expenditure of force. The use of individual clamping springs also advantageously guarantees that the register pins and the adjusting device, the latter preferably being arranged in the groove, are clearly visible, so guaranteeing simple and obvious operation.

A particularly useful further development of the invention consists in that behind each clamping spring, which corresponds in each case to a plate end, a slider being movable in axial direction is positioned, having at least one expanding knob facing which there is, on the spring side, a corresponding locking hollow. In the lock-in position, when the expanding knob slides into the facing hollow, the spring in question makes contact. In order to disconnect the spring, the expanding knob is simply pushed out of the hollow. The preceding measures thus form the basis for an extremely simple and operationally safe device for actuating the springs.

The slider mentioned can, in an advantageous way, be provided with an actuating claw which undergrasps the corresponding spring and projects into the groove, and which has at its free end a toothing which can be brought into contact with the beard of a key. This measure clearly guarantees a highly desirable ease of operation from the groove opening and assures extremely sensitive and safe slider actuation. It is expedient if a key block can be provided in the groove for accommodating the key, the block being provided with at least one matching key hole that is accessible from the groove opening and has, at the level of the claw, a through window for the key beard. This guarantees, for one, extremely easy manipulation of the key and for the other, that the key can only be removed if the key beard is within the through window mentioned, i.e., when the clamping action is completed. In this way operational problems can be largely excluded.

A further particularly useful measure consists in that the sliders of opposing clamping springs are provided with symmetrically-arranged actuating claws, corresponding to which there is always a common keyhole having two opposing through windows. This measure proves extremely space-saving and facilitates operation.

For arrangements where printing plates are to be clamped pairwise, next to each other, or where double-width plates, so-called panoramic plates, are to be clamped, it is expedient to provide a clamping arm per plate width, each arm being separate and being provided with a corresponding clamping spring. With this setup the support bar can advantageously extend the whole length of the groove in one piece, being provided with adjacent clamping springs each corresponding to a plate end. With arrangements of this sort it is particularly expedient if the sliders of adjacent clamping springs can be opposingly actuated and be provided with actuating claws in the region of the ends, which face each other. In this way a common key block having two neighboring keyholes can advantageously correspond to these actuating claws. As a further improvement of the invention this measure proves extremely space-saving and simplifies operation. It is useful if the key block has a length corresponding to about half that of the groove and is positioned approximately in the middle of the groove, so that one key suffices.

A further particularly useful measure can consist in the clamping springs being held by self-locking screws fitting into open slits and being secured by headless pin stops fitting into corresponding holes. This measure guarantees simple exchangeability of the clamping screws without completely unscrewing the screws, which could considerably facilitate any necessary maintenance work.

As a further improvement of the invention the clamping arms can be provided with hinge pins at the free end of their bearing arm, the pins being set in corresponding hinge sockets secured by a removable cover plate. This measure guarantees simple assembly or disassembly of the complete clamping arm-clamping spring unit, which can be pre-assembled outside the groove, without necessitating axial assembly space.

In a further development of the invention the clamping arms can be actuated by means of a corresponding adjusting claw which makes contact with the bearing arm in the region between the hinge pins and the pressure springs; the adjusting claw itself is actuated by means of a cam supported in a bearing block which is situated in the groove and laps over the adjusting claw in a portal manner. This provision offers an advantageous, simple and robust adjusting mechanism which, for assuring convenient operation, can easily be accommodated in the groove without necessitating a special recess in the latter. It is useful here if the adjusting claw mentioned has a pilot guided in a guide bush and supported on a retractile spring. In this way, for one, clean, swing-free guidance of the adjusting claw and for the other, a clean return and thus rattle-proof operation are assured.

Another particularly useful measure for mounting the register pins consists in that these, exending from the clamping arm or support bar in direction of the plate attachment arm are arranged as a prolongation of the bearing block, which is positioned in the longitudinal direction of the groove. As a result of using separate springs in the region of the clamping arm and the support bar, there is an excellent view of the register pins here. In a particularly perfected version these can be attached on lock-type slides being arranged in a guiding device running in the longitudinal direction of the groove; this advantageously enables a correction to compensate for the unavoidable enlargement, increasing from printer to printer, of the paper web.

In order to guarantee particularly simple and safe manipulation of the key, it is advantageous to provide a bridge-like key guide between the key block and the bearing block accommodating the actuating cam.

A particularly useful form of support bar consists in this having a foot resting on the floor of the groove, being held by screws and secured by fixing pins. The fixing pins advantageously simplify exchanging the support bar, without any adjustment being necessary.

Other objects and features of the present invention will become apparent from the following detailed description when taken in connection with the accompanying drawings which disclose one embodiment of the invention. It is to be understood that the drawings are designed for purposes of illustration only, and are not intended as a definition of the limits and scope of the invention disclosed.

In the drawings, wherein similar reference numerals denote similar elements throughout the several views.

Figure 1:
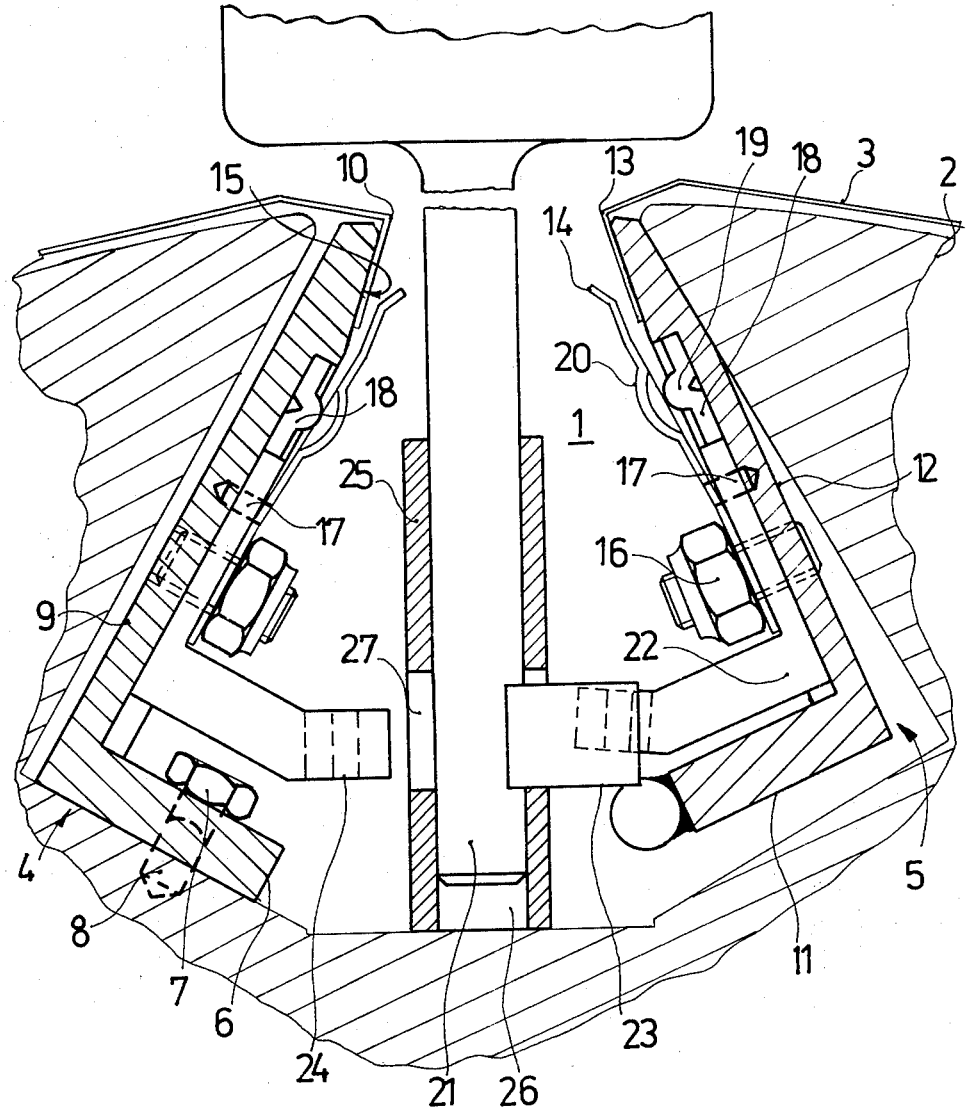
FIG. 1 is a lateral sectional view through a quick-acting clamping device according to the invention, taken in the region of the slider actuating claws.

In FIG. 1, 1 shows a groove, formed by milling etc., of a plate cylinder 2, for reasons of technical representation shown only in section, on which flexible printing plates of the sort shown by 3 are to be clamped. The length of the printing plates 3 corresponds to about half the circumference of the cylinder. There must therefore be a second groove, not shown here, opposite to the groove 1. The printing plates to be clamped grip with their front end, with respect to the direction of rotation, in the one groove and with their rear end, with respect to the direction of rotation, in the opposite groove. The length of the groove corresponds to about half the width of the cylinder, which is normally constructed to hold four plates, so that there is room for two plates next to each other in the area of each groove.

Figure 3:
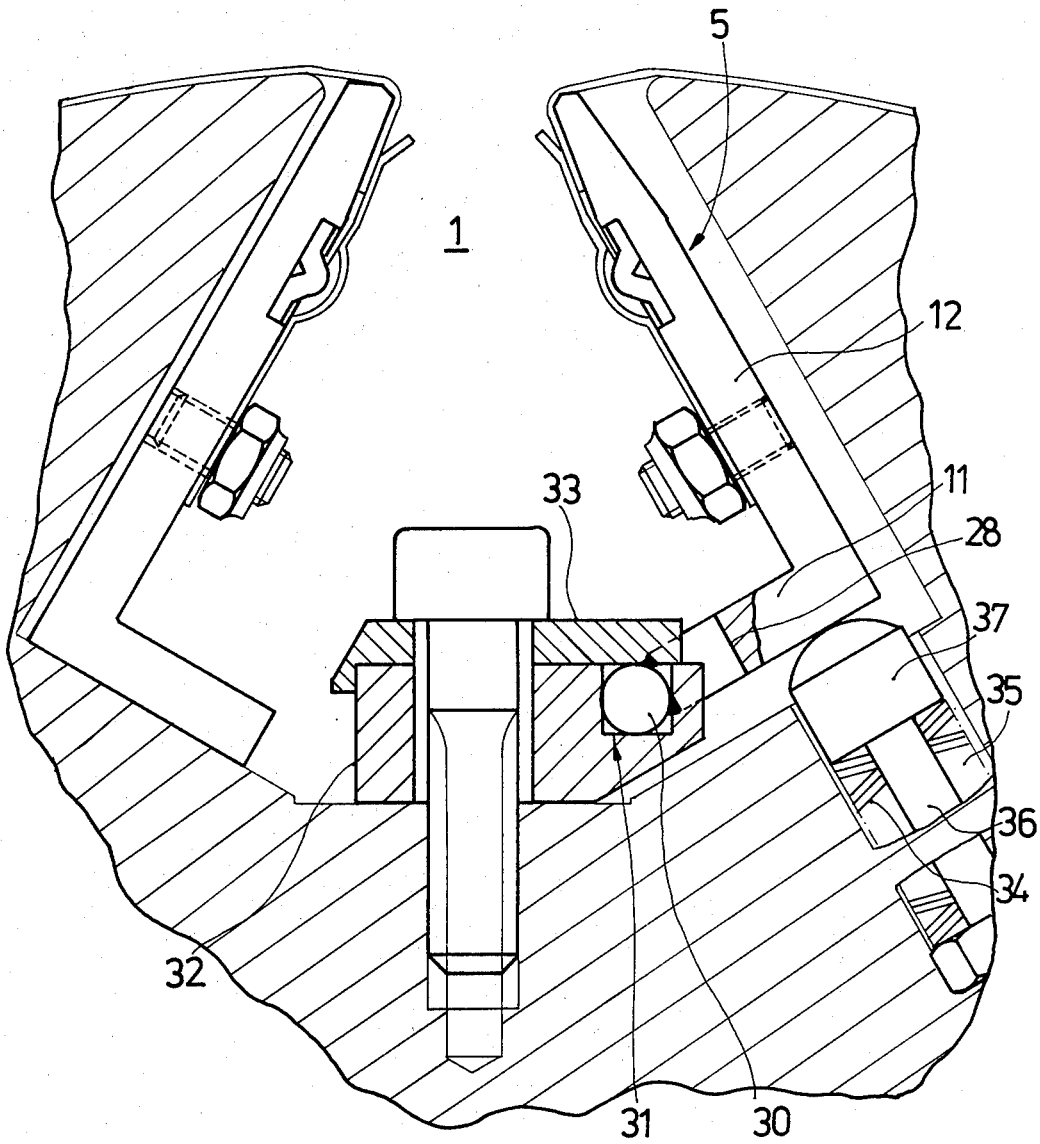
FIG. 3 is a sectional view similar to that of FIG. 1, showing the mounting of the clamping arm.
Figure 4:
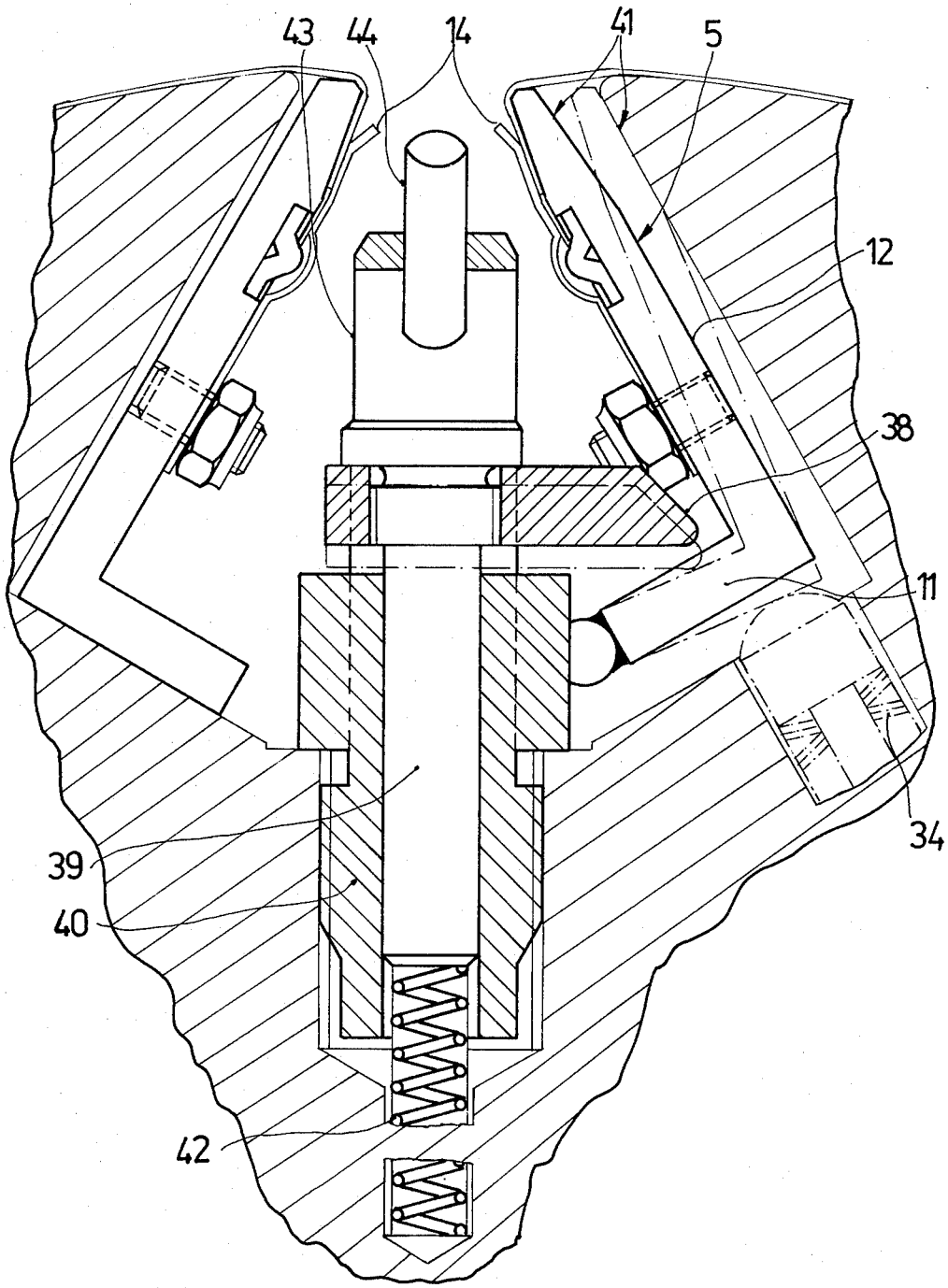
FIG. 4 is a sectional view similar to that of FIGS. 1 and 3, showing the clamping arm adjusting device.

The clamping device arranged in the groove 1 has, at the front side of the groove with respect to the direction of rotation, a practically rigid support bar 4 and, at the rear side of the groove with respect to the direction of rotation, a swingably-mounted clamping arm 5. The support bar 4 rests with its foot 6 on the floor of the groove. The foot 6 is bolted to the floor of the groove by screws, indicated here by a head 7. In order to keep the support bar 4 securely in position, it is useful to provide fixing pins 8, which also considerably facilitates exchanging the support bar 4. Connected to the foot 6 of the support bar 4 there is a plate attachment arm 9, running approximately parallel to the wall and into which the bent front end 10, with respect to the direction of rotation, of a printing plate 3 can be inserted. The clamping arm 5 has, near to the floor, a bearing arm 11, this being swingably suspended at its free end in a manner to be described in more detail later. Connected approximately vertically to the bearing arm 11 there is a plate attachment arm 12, which can be brought into operative connection with the bent rear end 13, with respect to the direction of rotation, of a printing plate. The clamping arm 5, as will be described in more detail by means of FIGS. 3 and 4, is acted upon in the clamping direction by pressure springs not shown in more detail in FIG. 1 but being arranged approximately as an extension of the plate attachment arm 12, and can, by means of a suitable adjusting device, be swung against the force of these pressure springs.

It is advantageous, as experience has shown, to grip the ends 10 and 13 of the printing plates to be clamped before the actual clamping action itself proceeds. For this purpose the plate attachment arms 9 and 12 of the support bar 4 and clamping arm 5 respectively are provided in each case with separate clamping springs 14, these working in combination with corresponding opposing surfaces 15 of the plate attachment arms 9 and 12. The clamping springs 14 can advantageously be constructed as simple leaf springs, whose length corresponds to a normal plate width. 16 shows the provision of self-locking screws 16 for holding the clamping springs 14; it is useful if the screws engage here in downwardly-opening slits of the leaf springs forming the clamping springs 14, as this renders the exchanging of the clamping springs 14 much easier. In order to secure the clamping springs 14 against radial forces working outwards, it is expedient to provide headless pin stops, indicated here by 17, which fit into corresponding holes in the leaf springs forming the clamping springs 14 and from which the clamping springs 14 can be taken out by simply loosening the screw 16. In order to enable easy insertion of the bent plate ends 10 and 13, the clamping springs 14 can be brought into or out of contact with the corresponding opposing surfaces 15. Since the support bar 4 and the neighboring clamping arm 5 work in connection with different plates in each case, the means to connect or disconnect the clamping springs 14 should be independent of any actuation of the clamping arm or of the opposing clamping spring. For this reason, in the example illustrated, there is a slider 18, being movable in axial direction and having along its length a number of expanding knobs of the sort shown by 19, provided behind each clamping spring 14. Facing the expanding knobs 19 there are, on the spring side, corresponding locking hollows 20. In order to bring the clamping spring 14 into contact with the corresponding opposing surface 15, the corresponding slider 18 is so positioned in axial direction that the expanding knobs 19 go into the locking hollows 20 provided for this purpose. As soon as the slider 18 is pushed out of this position, the expanding knobs 19 are forced out of the locking hollows 20 and thus cause the corresponding clamping spring 14 to be lifted from the clamped object. The expanding knobs 19 and the locking hollows 20 can be made advantageously by a corresponding non-cutting pressing process. In the example illustrated the slider 18 is inserted in a corresponding slot of the plate attachment arm 9 or 12 in order to enable easy axial guiding. It is useful if the slider 18 extends somewhat beyond the entire spring length of the corresponding clamping spring in each case, as this guarantees uniform spring actuation over the whole spring length.

Figure 2:
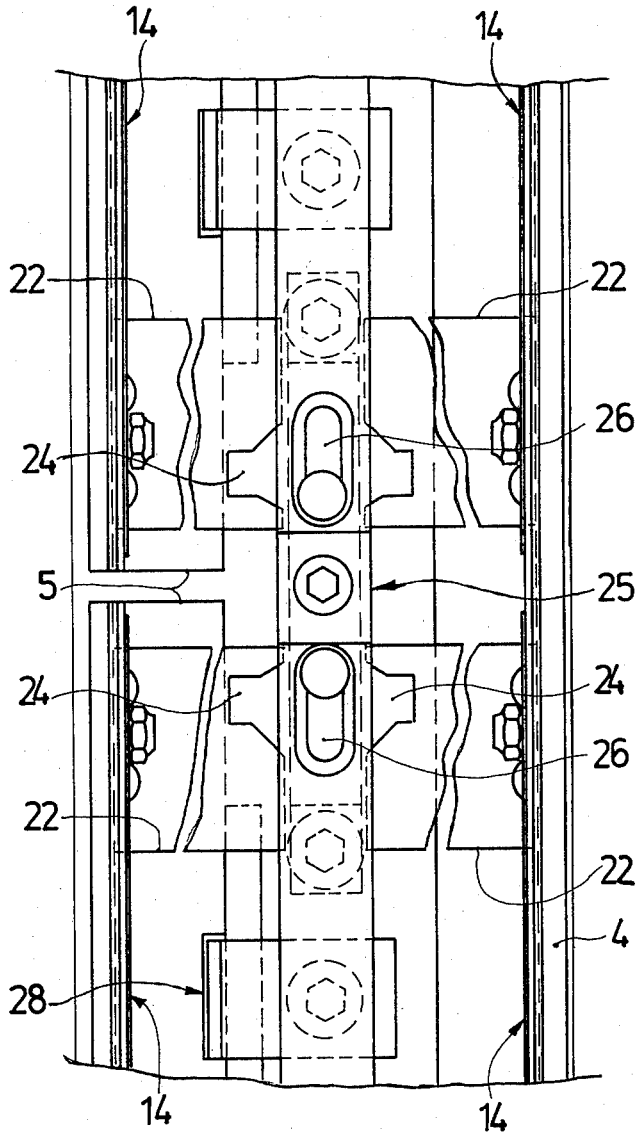
FIG. 2 is a top view of the arrangement according to FIG. 1.

For actuating the slider 18 it is useful to employ a key such as is shown in FIG. 1 by 21, which can be brought into locking contact with the sliders 18. To achieve this the sliders 18 are each provided with an actuating claw 22 which undergrasps the corresponding clamping spring 14 and projects into the groove 1, and which has at its free end a toothing 24 which can be brought into contact with the beard 23 of the key 21. The toothing 24 can, as can best be seen from FIG. 2, be constructed simply as corresponding key indentations of the actuating claw 22, which at its free end is of flap-like design. By turning the key 21 the desired slider can thus be brought into the desired axial position. To accommodate the key 21 when actuating the slider 18 it is useful to provide a key block, as shown by 25 in FIG. 1, the block being positioned approximately in the middle of the groove and, as best seen from FIG. 2, being provided with a matching keyhole 26. At the level of the respective neighboring actuating claw 22, the corresponding key block 25 is provided with a window that is accessible from the keyhole 26, as is indicated in FIG. 1 by 27. In the example illustrated the key block 25, being positioned approximately in the middle of the groove, is provided with two opposing windows 27, which advantageously make it possible to use the key from both sides. The sliders of the clamping springs 14, these being opposite to each other in each case, are provided for this purpose, as can be seen especially well from FIG. 2, with actuating claws 22 which lie practically opposite each other and are approximately symmetrical.

The groove 1 should, as already explained above, be long enough to accommodate two plates next to each other. Naturally, however, the measures according to the invention can also be employed with arrangements having a longer groove length. In the example illustrated there is, as can clearly be seen from FIG. 2, a clamping arm 5, being equipped with at least one corresponding clamping spring 14, provided for each plate width. The nonmovable support bar 4 is expediently constructed as a single element extending over the entire length of the groove and having at least one clamping spring 14 per plate width. The sliders 18 belonging to adjacent clamping springs 14, of the through support bar 4 or the clamping arm 5 opposite this, are provided, as clearly seen in FIG. 2, with actuating claws 22 in the region of the ends facing one another; the latter are thus close together, which advantageously means that a common key block 25, being provided with two neighboring keyholes 26 and having a length corresponding to about half the length of the groove, suffices. It is expedient if the neighboring sliders can be opposingly actuated, so that there is no danger of collision here. The toothing 24 of adjacent actuating claws 22 can in this connection be simply symmetrically designed. The clamping arm 5 is, as already explained, swingably mounted. In this connection, as clearly shown in FIG. 3, its bearing arm 11 is expediently provided in the region of its free end with two hinge pins 30, being axially staggered with respect to one another and being inserted in a hinge socket formed by a slot 31 in a bearing bar 32. In order to secure the hinge pins 30, the slot 31 is covered by a removable cover plate 33, which is bolted to the bearing bar 32. In order to disassemble the clamping arm 5 it is thus only necessary to remove the cover plate 33, which can be done from the groove opening without any problem. The clamping arm 5 can then be lifted out of the slot 31, together with its hinge pins 30. Free assembly space in the axial direction is thus advantageously rendered unnecessary. In the illustrated example the hinge pins 30 are to be simply welded onto the front end of the bearing arm on both sides of the region coming into contact with the bearing bar 32. In the axial region of the bearing bar the hinge pins 30 are laid bare by a corresponding recess in the bearing arm 11, as shown by 28. In order to actuate the clamping arm 5 in the clamping direction there are pressure springs of the sort shown in FIG. 3 by 34, which are arranged approximately as an extension of the plate attachment arm 12 and are supported by the housing. In this connection it is useful to have a larger number of such pressure springs distributed over the length of the clamping arm 5, as this enables uniform actuation of the clamping arm 5. The operating direction prescribed here for the spring power, in the direction of the relatively high plate attachment arm 12, guarantees that no notable deformations of the clamping arm can occur. In the example illustrated, the pressure springs 34 are constructed as cup spring packets which are arranged in corresponding holes in the housing. In the example shown there is a plunger 37 provided between the actual spring packet and the clamping arm 5, having a shaft 36 which passes through each corresponding spring packet. This assures clean-cut spring support.

In order to actuate the clamping arm 5 against the force of the pressure springs 34 there is, as best seen from FIG. 4, an adjusting claw 38 provided, being arranged above the bearing arm 11 of the clamping arm 5 and being pressed down in a manner still to be described in more detail; in working position the adjusting claw presses from above on the bearing arm 11 so that the clamping arm 5 is moved back. The adjusting claw 38 is provided with a pilot 39 which is guided in a corresponding guide bush 40 being bolted to the floor of the groove; this guarantees complete exclusion of swinging. The rest position of the adjusting claw 38 is indicated in FIG. 4 in heavy print. In this position no force is exercised on the clamping arm from the adjusting claw side, so that the tensional force of the pressure springs 34 can be fully effective. With this adjusting claw position the clamping arm 5 can accordingly effect the desired pressure on the plates. In the pressed down working position, as shown in FIG. 4 by dot-dash line, the adjusting claw 38 presses the bearing arm 11 down so that the plate attachment arm 12 of the clamping arm 5 is moved back. In the example illustrated the plate attachment arm 12 is slightly canted, as shown by 41, in order to achieve a close contact surface to the neighboring side wall of the groove. In this position the plate end in question can be conveniently secured in position by corresponding actuation of the clamping spring 14. To the same degree as the adjusting claw 38 is released, the clamping arm 5, under action of the pressure springs 34, returns to its clamping position. In so doing, the bearing arm 11 also takes the adjusting claw 38 with it. In the particularly preferred embodiment shown, a restoring spring 42, supported against the housing and working in conjunction with the pilot 39, is provided for the return movement of the adjusting claw 38. In this way the adjusting claw 38 is held securely in its starting position and there is no rattling etc. to be feared during normal operation. For pressing down the adjusting claw 38 it is useful to provide a cam, as shown by 43, which can be turned by means of a rod etc. In the example shown the cam 43 is provided with a guide pin 44, onto which a sufficiently long tube can be fitted.

Figure 5:
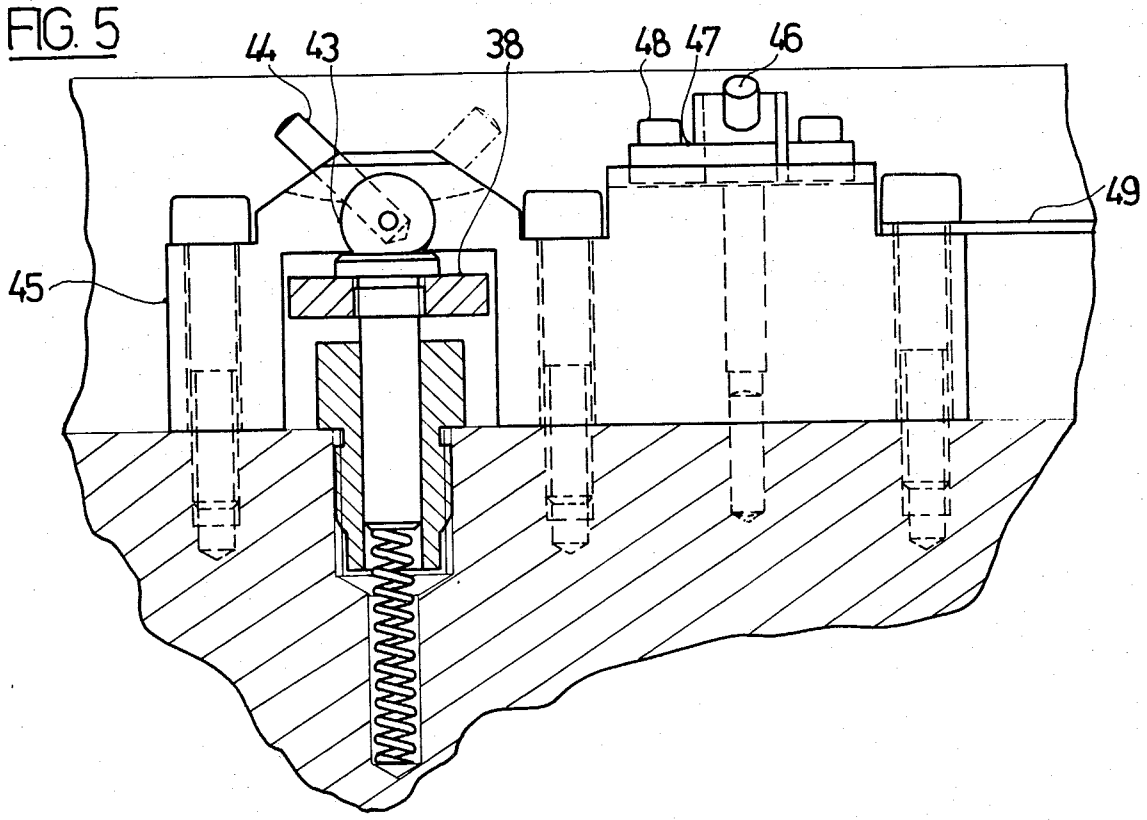
FIG. 5 is a lateral view of the arrangement according to FIG. 4, partly in section.

The cam 43 is housed, as can be seen particularly clearly in FIG. 5, in a bearing block 45 which embraces the adjusting claw 38 in a portal manner and is securely bolted to the floor of the groove. The cam 43 can be formed, as clearly shown in FIG. 5, by simply providing a correspondingly flattened disc. The bearing block 45 runs approximately in the longitudinal direction of the groove. In the example illustrated the bearing block is extended in a preferable manner beyond the region of the adjusting claw in order to accommodate the register pins 46. The register pins 46 arranged here extend in the direction of the clamping arm or support bar, so that the corresponding slits in the plate ends are to be guided past here. In the example illustrated the register pins 46 are fixed to slides 47 which can be shifted in the longitudinal direction of the groove; this advantageously makes a corresponding correction possible. Normally the slides 47 are secured in position by locking screws 48, and are leaded to avoid any misuse. It is obvious that one adjusting claw 38 must be provided per clamping arm 5. The corresponding bearing blocks 45 are, as previously mentioned, laterally displaced with respect to a common keyblock 25. The free space between such bearing blocks and the key block 25 can, as indicated by 49 in FIG. 5, thus be expediently bridged by a key guide rod, which renders manipulation of the key particularly easy.

The preceding explanations render the setup and function of the clamping device according to the invention clearly recognizable. By pressing down the adjusting claw 38 the clamping arm 5 is brought out of the clamping position. For insertion of the respective plate end, the clamping springs 14 can be brought out of and then into clamping position again with the help of the key 21. The key 21 can only be taken out of the corresponding key block 25 when the key beard 23 does not coincide with one of the windows 27, i.e., only after the gripping action is finished. As soon as the latter is finished, the clamping action can be begun by correspondingly releasing the adjusting claw 38. When clamping so-called panoramic plates, which extend over several plate widths, first of all, in accordance with the above explanations, the required clamping springs 14 lying adjacent to one another are actuated. On completion the gripping action the corresponding clamping arms in action are preferably brought into clamping position by simultaneous release of their adjusting claws 38.

While only one embodiment of the present invention has been shown and described, it will be obvious to those persons of ordinary skill in the art, that many changes and modifications may be made thereunto, without departing from the spirit and scope of the invention.

What is claimed is:

1. A device for the rapid clamping of flexible printing plates on the rotatable printing cylinder of rotating printing presses, which cylinder has at least one longitudinally-extending groove opening onto a circumferential surface thereof, which groove has a base and a front and rear side, with respect to the direction of rotation thereof, of the type which includes at least one support bar positioned adjacent to the front side of said groove and bolted to the base of said groove, said support bar having a plate attachment arm to which a front end, with respect to the direction of rotation, of a printing plate can be clamped, at least one clamping arm lying in said groove opposite to said support bar and being pivotably mounted in said groove, said clamping arm having a bearing arm to which is secured a plate attachment arm which extends generally normally therefrom and to which a rear end, with respect to the direction of rotation, of a printing plate can be clamped, at least one pressure spring coupled to said clamping arm of biasely acting upon said clamping arm in a direction towards said front side of said groove which represents the clamping direction of said clamping arm, said spring extending approximately in the direction of the plate attachment arm of said clamping arm, and an adjusting device for actuating said plate attachment arm of said clamping arm against the force of said spring the improvement comprising:

said support bar and said clamping arm each having at least one clamping spring secured to said plate attachment arm thereof for gripping the front and rear end of said printing plate, respectively, said plate attachments arms each having a slider slidably mounted thereon and disposed for cooperative engagement with the associated spring of said plate attachment arm which slider is movable between a clamping position in which it moves at least a portion of said associated clamping spring into biased engagement with an opposing surface of said plate attachment arm to which it is secured and a non-clamping position, in which it moves at least a portion of said associated clamping string into a non-engaging position relative to said opposing surface of said plate attachment arm to which it is secured, the respective plate attachment arms of said support bar and clamping arm being separate by a space defining a channel, said sliders each having an actuating claw secured thereto which has a free end disposed in said channel on which is a toothing and wherein said device additionally includes a key having a beard which may be inserted into said channel and brought into separate contact with said toothing of each of said free ends of said claws whereupon turning of said key effects movement of said sliders between said clamping and non-clamping position, so as to, in turn, permit movement of said portions of said clamping springs into and out of engagement with said opposing surface of said support bar and clamping arm, respectively, independently of each other and of any pivotal movement of said clamping arm.

2. The device according to claim 1, wherein each of said sliders has at least one protruding knob formed thereon which is disposed for engagement with the clamping spring associated therewith and wherein each of said clamping springs has a corresponding locking hollow which, in said clamping position, mates with said knob of its associated slider.

3. The device according to claim 1, wherein said support bar has a foot resting on the base of said groove, which is held by screws and secured by fixing pins thereto.

4. The device according to claim 1, wherein a key block is provided in said groove for accommodating said key when one of said sliders is actuated, said key block being provided with at least one keyhole for said key that is accessible from the groove opening and has, at the level of said claw, at least one through window for said key beard to engage with said toothing.

5. The device according to claim 4 additionally including at least one adjusting claw disposed in said groove for movement between a non-contacting and contacting position relative to said bearing arm of said clamping arm so as to effect pivotal movement thereof, a cam disposed in said groove for cooperative engagement with said adjusting claw, said cam being movable between a first position in which it permits movement of said adjusting arm into said non-contacting position and a second position in which it moves said adjusting arm into said contacting position, and a bearing block mounted in said groove in which said cam is supported and which laps over said adjusting claw in a portal manner.

6. The device according to claim 5, additionally including a guide bush mounted in the base of said groove, a retractable spring mounted in said guide bush and a pilot slidably mounted in said guide bush which is in biased engagement with said retractable spring, said pilot supporting said adjusting claw.

7. The device according to claim 5, wherein said key block and said bearing block are spaced apart and wherein the space between said bearing block and said key block is bridged by means of a key guiding rod.

8. The device according to claim 4, wherein the sliders of adjacent clamping springs can be opposingly actuated and are provided, in the region of their ends, which face each other, with said actuating claws, and wherein said key block is provided with two adjacent keyholes for permitting independent actuation of said sliders.

9. The device according to claim 8, wherein said key block has a length corresponding to about half that of said groove and is positioned in the middle of said groove.

10. The device according to claim 4, wherein the sliders of opposing clamping springs are provided with symmetrically-arranged actuating claws, and wherein said keyhole of said keyblock serves as a common keyhole for the key for said actuating claws, said key block having two opposing through windows, at the levels of said claws to permit engagement of said key beard with the toothing of said claws.

11. The device according to claim 1, wherein said device additionally includes at least one hinge socket disposed adjacent to the base of said groove and a removable cover plate which covers said hinge socket and wherein said bearing arm of said at least one clamping arm has a free end on which is mounted at least one hinge pin which is rotatably received with said hinge socket so as to permit pivoting of said clamping arm.

12. The device according to claim 1, wherein said clamping springs are held by self-locking screws fitted into open slits formed in said plate attachment arms and are also secured thereto by headless pin stops.

13. The device according to claim 1, wherein there is at least one clamping arm, having at least one clamping spring for each plate secured on said printing cylinder.

14. The device according to claim 13, wherein said support bar is of one-piece construction and extends over the whole length of said groove and is provided with at least one clamping spring per plate secured on said printing cylinder.

15. The device according to claim 1, wherein register pins extend from the support bar and the clamping arm in the direction of the plate attachment arms and are arranged on an elongation of the bearing block which is positioned in the longitudinal direction of the groove.

16. The device according to claim 15, wherein said register pins are attached to lock-type slides which are arranged in a guiding device running in the longitudinal direction of the groove.

* * * * *

UNITED STATES PATENT AND TRADEMARK OFFICE

CERTIFICATE OF CORRECTION

PATENT NO. : 4,223,604

DATED : SEPTEMBER 23, 1980

INVENTOR(S) : BREHM ET AL

It is certified that error appears in the above—identified patent and that said Letters Patent is hereby corrected as shown below:

Column 8, line 67, after "completion" insert --of--. Column 9, line 29, change "of" to --for--. Column 10, line 59, change "keyblock" to --key block--. Column 12, line 10, change "to" to --on--.

Signed and Sealed this

*Third* Day of *February 1981*

[SEAL]

*Attest:*

RENE D. TEGTMEYER

*Attesting Officer*

*Acting Commissioner of Patents and Trademarks*